US006122480A

United States Patent [19]

Hwang

[11] Patent Number: 6,122,480

[45] Date of Patent: Sep. 19, 2000

[54] METALLIC CORE RAPID WARM-UP FUSER ROLLER

[75] Inventor: Shyshung S. Hwang, Penfield, N.Y.

[73] Assignee: Xerox Corporation, Stamford, Conn.

[21] Appl. No.: 09/405,077

[22] Filed: Sep. 27, 1999

[51] Int. Cl.[7] ..... G03G 15/20

[52] U.S. Cl. ..... 399/334; 399/328; 399/333

[58] Field of Search ..... 399/328, 122, 399/320, 330, 333, 334; 219/216

[56] References Cited

U.S. PATENT DOCUMENTS

| | | | |
|---|---|---|---|
| 4,395,109 | 7/1983 | Nakajima et al. | 355/3 FU |
| 4,820,904 | 4/1989 | Urban | 219/216 |
| 4,888,464 | 12/1989 | Shibata et al. | 219/216 |
| 5,173,736 | 12/1992 | Cherian | 355/285 |
| 5,349,423 | 9/1994 | Nagato et al. | 399/122 |
| 5,450,182 | 9/1995 | Wayman et al. | 355/285 |
| 5,708,950 | 1/1998 | Badesha et al. | 399/333 |
| 5,722,025 | 2/1998 | Morigami et al. | 399/330 |
| 5,744,200 | 4/1998 | Badesha et al. | 427/387 |

OTHER PUBLICATIONS

P. 4 of Report No. X9300431, "Modeling of Instant–On Integral Heating Annular Resistor Roll Fuser", by S. Hwang, Jun. 1993. p. 4 describes Canon's PC–1 model.

*Primary Examiner*—Quana M. Grainger
*Attorney, Agent, or Firm*—John M. Kelly

[57] ABSTRACT

A rapid warm-up fuser roller (and fusers and marking machines that use such a fuser) comprised of a metallic cylindrical core, a thermally and electrically insulating layer of volume graft over the metallic core, a resistive heating layer over the insulating layer, and electrical connections to the resistive heating layer such that electrical current passing through the electrical connections flows through the resistive heating layer in a direction that is substantially parallel to the axis of the metallic core. The electrical current causes the resistive heating layer to heat while the insulating layer of volume graft enables rapid warm-up of the roller.

20 Claims, 3 Drawing Sheets

METALLIC CORE RAPID WARM-UP FUSER ROLLER

This invention relates to electrophotographic printing machine fusers. More particularly, it relates to fusers having rapid warm up fuser rollers.

BACKGROUND OF THE INVENTION

Electrophotographic marking is a well-known, commonly used method of copying or printing documents. Electrophotographic marking is performed by exposing a charged photoreceptor with a light image representation of a desired document. That light image discharges the photoreceptor, creating an electrostatic latent image of the desired document on the photoreceptor's surface. Toner particles are then deposited onto that latent image, forming a toner image. That toner image is subsequently transferred from the photoreceptor onto a substrate, such as a sheet of paper. The transferred toner image is then fused to the substrate, usually using heat and/or pressure, thereby creating a permanent image. The surface of the photoreceptor is then cleaned of residual developing material and recharged in preparation for the production of another image.

When fusing toner onto a substrate it is beneficial to heat the toner to a point where the toner coalesces and become tacky. The heat causes the toner to flow into the fibers or pores of the substrate. Adding pressure increases the toner flow. Then, as the toner cools it becomes permanently attached to the substrate. To produce the heat and pressure for fusing, most fusers include a heated element and a pressure-inducing element that act together to form a nip. When a toner bearing substrate passes through that nip, heat from the heated element and pressure within the nip fuses the toner with the substrate.

One type of fuser uses a heated roller, called a fuser roller, and a nip-forming roller called a backup or pressure roller. Fuser rollers have been heated in different ways, including the use of an internal radiant heater, inductive heating, and by an internal resistive heating element. While fusers having a fuser roller and a backup roller have been very successful, they generally suffer from at least one significant problem: excessive warm-up time. When a typical prior art fuser roller using machine is turned on it might take several minutes for the fuser roller to warm-up to a point at which fusing can be performed. Furthermore, to conserve energy and to prolong the life of various internal components it is beneficial to remove power from the fuser roller heater when the fuser roller is not being used. However, it could then take several more minutes to re-heat the fuser roller. These delays are highly objectionable.

One approach to reducing fuser warm-up times is to pass electrical current through a resistive heating layer on a fuser roller such that the nip is directly heated. While such an approach is beneficial, it is difficult to implement in a long life fuser roller. This is partially because long life fuser rollers usually have metallic cores made from structurally rugged materials such as steel, stainless steel, or aluminum. Such metallic core fuser rollers are thermally conductive, and thus conduct heat away from the nip, and electrically conductive, and thus tend to short out resistive heating layers. Therefore, an insulating layer over the metallic core is usually used to prevent electrical shorting and excessive heat loss. Furthermore, to prevent damage to the resistive heating layer and toner sticking to the fuser roller, the resistive heating layer is usually coated with a protective release layer. However, even then such fuser rollers require a significantly long warm up time. At least one reason for the significantly long warm-up time is the materials used in prior art rapid warm up metallic core fuser rollers.

Some of the most effective ways of improving the warm-up time of metallic core fuser rollers are to reduce the heated thermal mass and/or to increase the thermal insulation. These properties depend on the materials used to make the fuser roller. The choice of materials suitable for use in metallic core fuser rollers is constrained by the material's function (electrical and thermal insulation, toner release, conformance), operating conditions (high temperature and pressure), and longevity requirements. One high conformance, high temperature material with good insulating and release properties is volume graft. Volume graft is a volume grafted elastomer invented by S. Badesha et. al. and described in U.S. Pat. No. 5,744,200. Volume graft has the beneficial characteristics of being thermally and electrically insulating, highly conformal, and thermally stable. Therefore, a rapid-warm up fuser roller having a metallic core with a volume graft insulating layer would be beneficial.

SUMMARY OF THE INVENTION

The principles of the present invention provide for a rapid warm-up metallic core fuser rollers and for marking machines that have rapid warm-up metallic core fuser rollers.

A fuser roller in accordance with the principles of the present invention is comprised of a metallic cylindrical core that is surrounded by an electrical and thermal insulating layer of volume graft. In turn, that insulating layer is covered with a resistive heating layer. Electrical contacts connect to the resistive heating layer such that electrical current can flow through the resistive heating layer in a direction that is substantially parallel to the axis of the core. The volume graft insulating layer prevents electrical shorting of the heating layer and reduces heat flow from the resistive heating layer into the metallic core. Beneficially, the resistive heating layer is overlaid with a release layer of volume graft. The metallic core is beneficially comprised of steel, stainless steel, or aluminum.

BRIEF DESCRIPTION OF THE DRAWINGS

Other aspects of the present invention will become apparent as the following description proceeds and upon reference to the drawings, in which.

DETAILED DESCRIPTION OF AN EMBODIMENT OF THE INVENTION

The preferred embodiment of the present invention includes a plurality of individual subsystems which are all known in the prior art, but which are used in a novel, non-obvious, and useful way. While the illustrated embodiment is a black and white digital copier, the present invention is clearly not limited to such systems. For example, and without limitation, the principles of the present invention can be used in other systems, such as color printing machines, facsimile machines, and digital copiers. Therefore, it is to be understood that the present invention is intended to cover all alternatives, modifications and equivalents as may be included within the scope of the appended claims.

Figure 1:
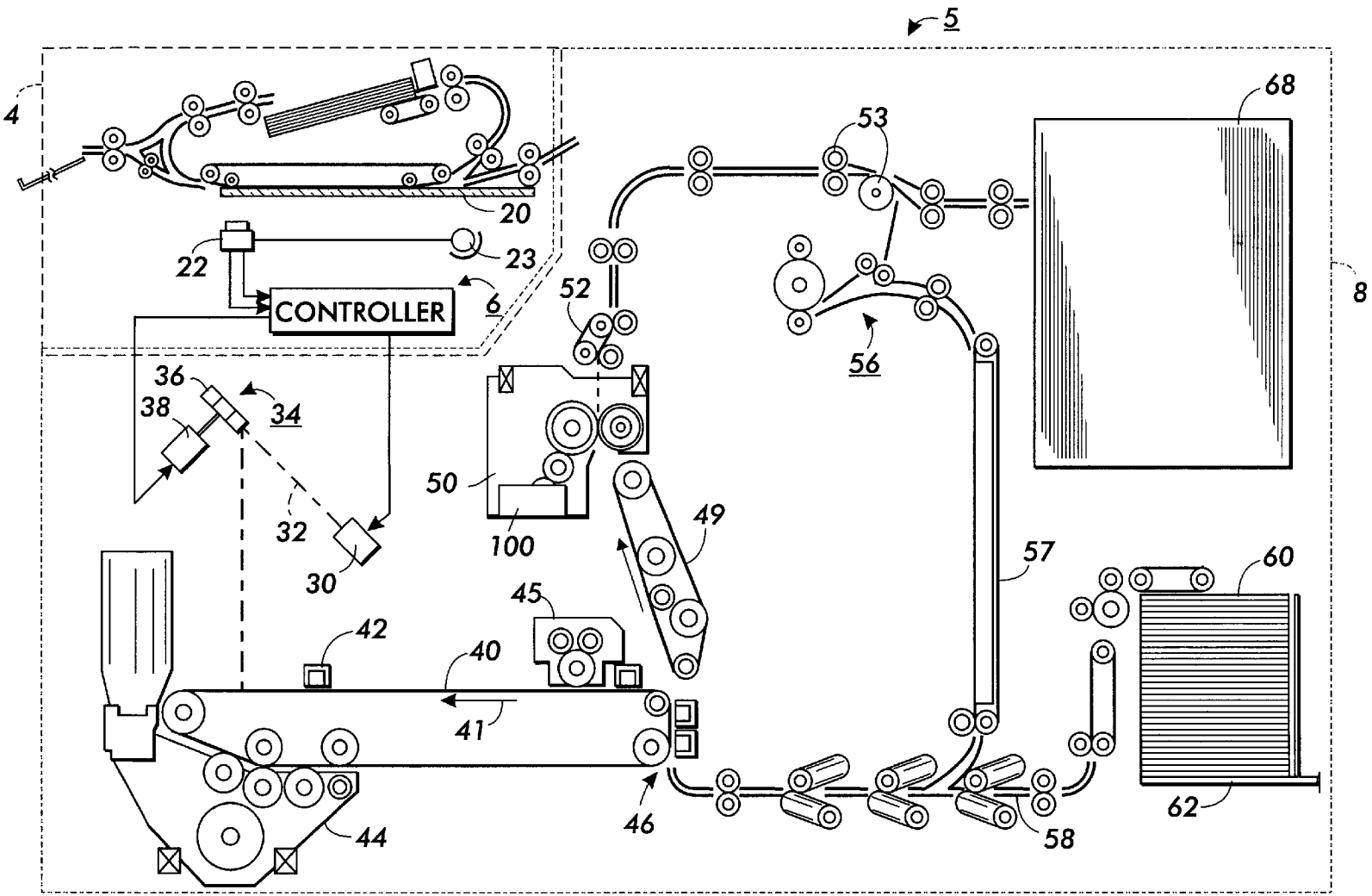
FIG. 1 is a schematic view depicting an illustrative electrophotographic marking machine, specifically a digital copier, that incorporates a fuser assembly in accordance with the principles of the present invention.

FIG. 1 shows an exemplary electrophotographic marking machine, specifically a digital copier 5, that is in accord with the principles of the present invention. Generally, the copier includes an input scanner 4, a controller section 6, and an electrophotographic printer 8. The input scanner 4 includes a transparent platen 20 on which a document being scanned is located. One or more photosensitive element arrays 22, which beneficially include charge couple devices (CCD), and a lamp 23 are supported for relative scanning movement below the platen 20. The lamp illuminates the document on the platen, while the photosensitive element array 22 generates image pixel signals from the light reflected by the document. After suitable processing the image pixel signals are converted to digital data signals that are sent to the controller section 6.

The controller section 6, sometimes called an electronic subsystem (ESS), includes control electronics that prepares and manages the flow of digital data to the printer 8. The controller section 6 may include a user interface that enables an operator to program a particular print job, a memory for storing information, and circuitry for synchronizing and controlling the overall operation of the copier 5. In any event, the controller section 6 sends processed digital data signals to the printer 8 as video data.

The printer 8 includes a raster output scanner that produces a latent electrostatic image on a charged photoreceptor 40. The raster output scanner includes a laser diode 30 that produces a laser beam 32 that is modulated in accordance with the video data from the controller section 6. The video data encodes the laser beam with information suitable for producing the desired latent image. The laser beam 32 is directed onto a rotating polygon 34 that has a plurality of mirrored facets 36. A motor 38 rotates the polygon. As the polygon rotates, the laser beam 32 reflects from the facets and sweeps across the photoreceptor 40 while the photoreceptor moves in the direction 41. The sweeping laser beam exposes an output scan line on the photoreceptor 40, thereby creating an output scan line latent electrostatic image.

Before exposure, the photoreceptor is charged by a corotron 42. After exposure, a developer 44 develops the resulting electrostatic latent image. The result is a toner image on the photoreceptor 40. That toner image is transferred at a transfer station 46 onto a substrate 60 that is moved from an input tray 62 to the transfer station by a document handler 58. After transfer, the substrate is advanced by a document transport 49 into a fusing station 50 that permanently fuses the toner image to the substrate 60. As the present invention is directly related to the fusing station, that station is discussed in more detail subsequently. After the toner image is transferred, a cleaning station 45 removes residual toner particles and other debris on the photoreceptor 40.

After fusing, the substrate 60 passes through a decurler 52. Forwarding rollers 53 then advance the substrate either to an output tray 68 (if simplex printing or after the fusing of a second image in duplex operation) or to a duplex inverter 56 that inverts the substrate. An inverted substrate travels via a transport 57 back into the document handler 58 for registration with a second toner image on the photoreceptor 40. After registration, the second toner image is transferred to the substrate at the transfer station 46. The substrate then passes once again through the fuser 50 and the decurler 52. The forwarding rollers 53 then advance the substrate to the output tray 68.

Figure 2:
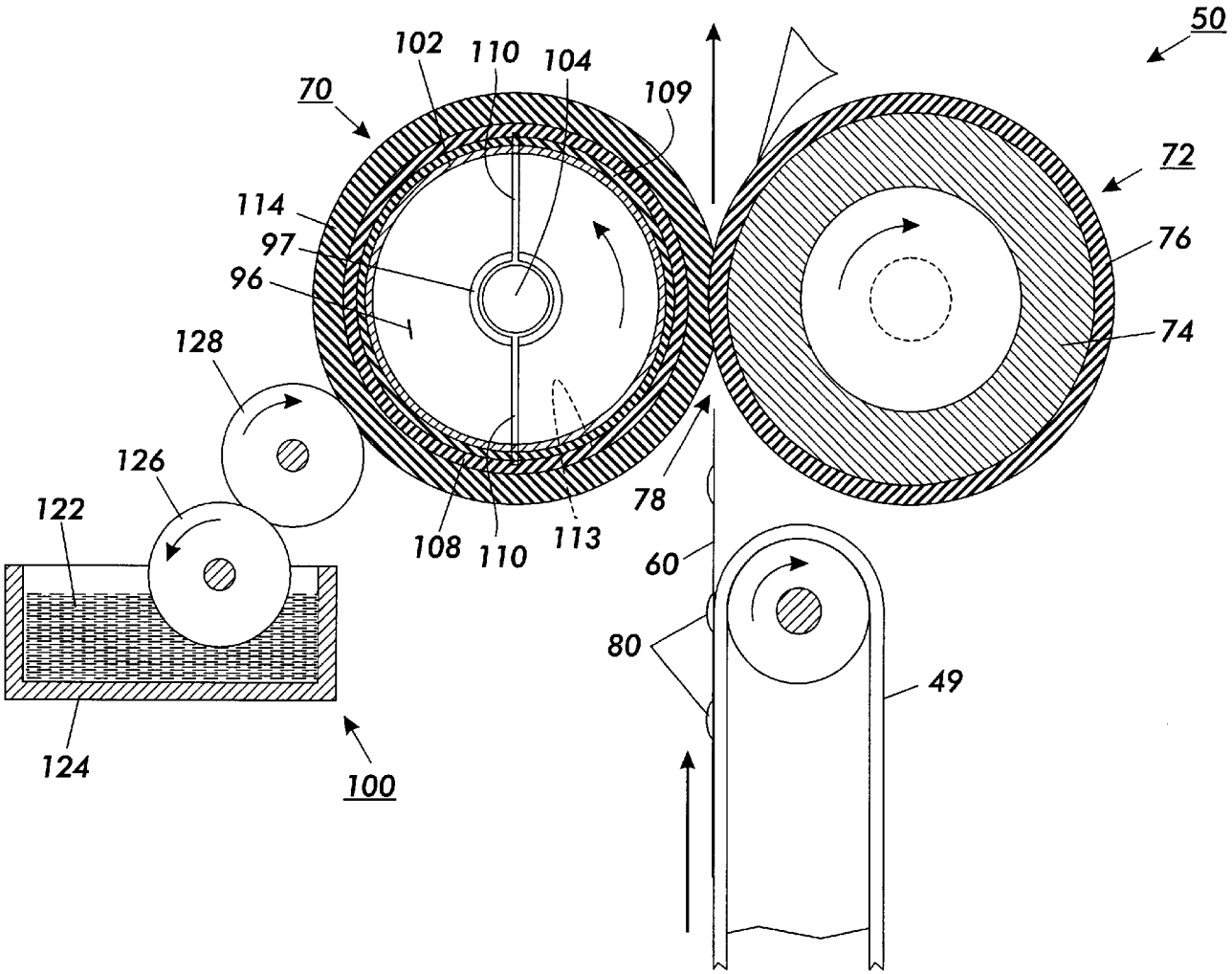
FIG. 2 illustrates a fuser assembly used in the digital copier illustrated in FIG. 1.
Figure 3:
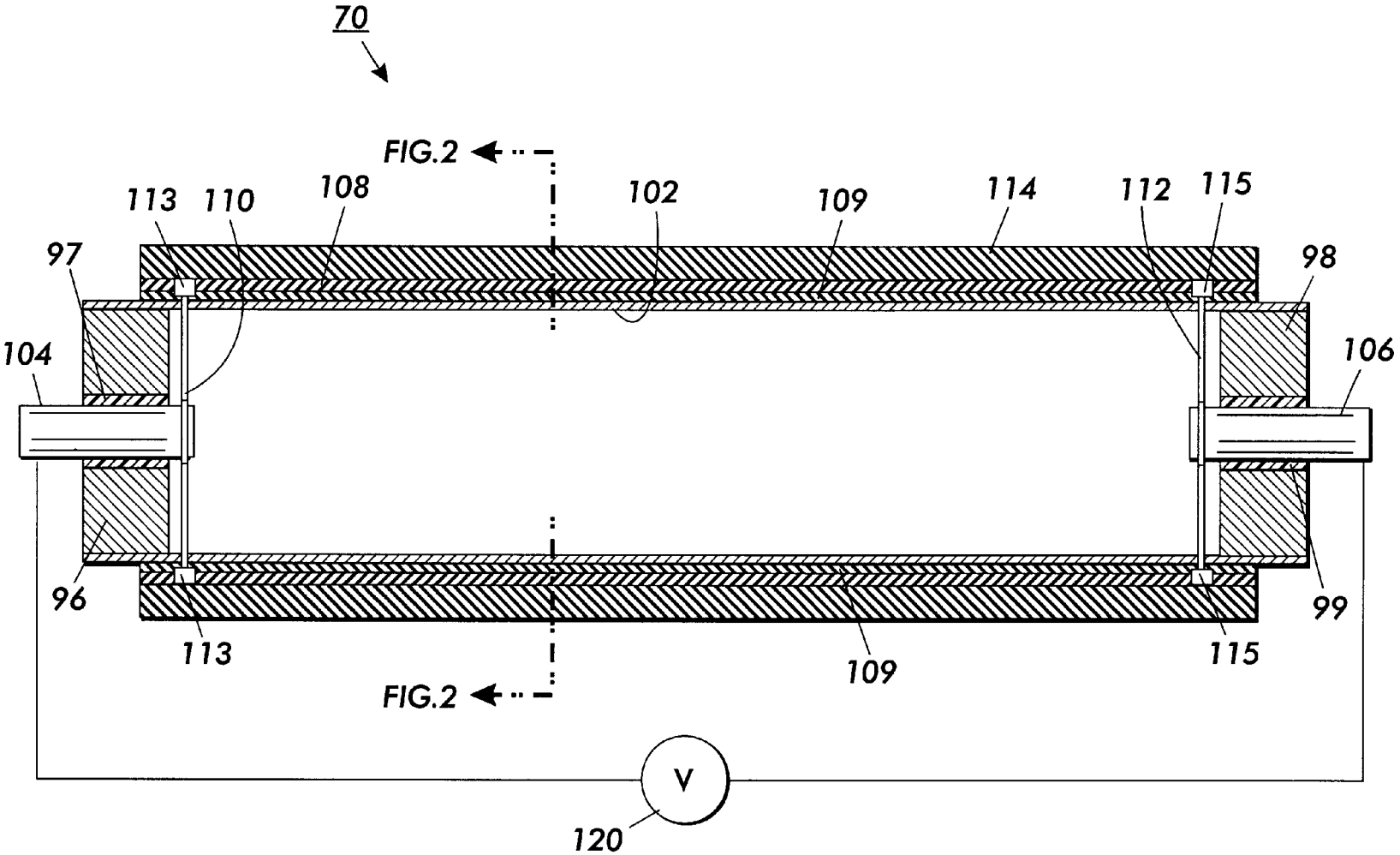
FIG. 3 illustrates a fuser roller used in the fuser assembly illustrated in FIG. 2.

As previously mentioned the subject invention is directly related to the fusing station 50. Attention is directed to FIG. 2, wherein the fusing station 50 that is used in the copier 5 is shown in more detail. That fusing station includes the fuser roller 70 and a back-up roller 72, together with a release agent management (RAM) system 100 (which is also shown in FIG. 1). Turning now to FIGS. 2 and 3, the fuser roller 70 is comprised of a metallic, cylindrically shaped core 102. Beneficially, the core 102 is comprised of steel, stainless steel, aluminum, or nickel. That core includes end caps 96 and 98. Extending from the end cap 96, but electrically isolated from it by a nylon bushing 97, is an electrically conductive axle 104. Extending from the end cap 98, but electrically isolated from it by a nylon bushing 99, is an electrically conductive axle 106 (see FIG. 3).

Surrounding the core 102 is an insulating layer 109 that is comprised of volume graft. Reference U.S. Pat. No. 5,744,200. Surround that insulating layer is a resistive heating layer 108. The insulating layer is beneficially about 5 microns thick while the resistive heating layer is beneficially a thick film resistive layer coated onto the insulating layer. Connected to one end of the resistive heating layer is a conductive ring 113. The insulating layer 109 electrically isolates the core 102 from the ring 113. Connected to the other end of the resistive heating layer is a conductive ring 115. The insulating layer 109 also electrically isolates the core 102 from the ring 115. Leads 110 connect the ring 113 to the axle 104 and leads 112 electrically connect the ring 115 to the axle 106. Finally, surrounding the resistive layer 108 is a release layer 114 that is comprised of volume graft.

Referring now to FIG. 3, in operation, a power supply 120 applies electrical power to the resistive layer 108 via the axles 104 and 106, the leads 110 and 112, and the rings 113 and 115. The electrical current from the power supply travels along the axis of the core, causing joule heating of the resistive layer. The insulating layer 109 thermally insulates the resistive heating layer 108 from the core 102, causing the generated heat to remain near the surface of the fuser roller 70. That heat then passes through the release layer 114.

Turning now to FIG. 2, the fuser station 50 also includes the backup roller 72. The backup roller 72 includes a metal core 74 that is surrounded by a heat-insulating layer 76. Both the fuser roller and the back-up roller are mounted on bearings (not shown) which are biased such that the fuser roller 70 and back-up roller 72 press against each other with sufficient pressure that a fusing nip 78 is formed. Heat from the fuser roller heats the nip when electrical power is applied to the fuser roller.

When a substrate 60 having toner 80 passes through the fusing nip 78 (with the toner contacting the fuser roller) the toner fuses to the substrate. The toner is prevented from sticking to the surface of the fuser roller by a release agent 122, such as a silicone oil, that is contained in a sump 124. The sump and release agent are part of the RAM system 100. The RAM system also includes a metering roller 126 and a donor roll 128. The metering roller is partially immersed in the release agent and contacts the donor roll for conveying the release agent to the surface of the donor roll. The donor roll is supported in contact with the fuser roller 70. Beneficially, a metering blade, which is not shown, serves to meter the release agent.

Table 1 provides a table of exemplary materials and material thicknesses. A metallic fuser roller according to table 1 warms up from 70° F. to 300° F. in about 2.8 seconds when using a power supply of 100 watts per inch. The 2.8 seconds warm-up time includes the existence of paper, toner layer and back-up roll 72. Furthermore, if the thickness of the resistor layer is reduced to 10 micrometer, the above warm-up time is reached in about 1.8 seconds.

TABLE 1

| Number | Material | Thermal Conductivity (w/cm-° C.) | Density (g/cm$^3$) | Specific Heat (J/g-° C.) | Thermal Diffusivity (cm$^2$/sec) | Thickness (microns) |
|---|---|---|---|---|---|---|
| | | Materials Properties and Thickness | | | | |
| 60 | Paper | $1.26 \times 10^{-3}$ | 0.8 | 1.89 | $8.3 \times 10^{-4}$ | 100 |
| 80 | Toner | $2.99 \times 10^{-3}$ | 1.27 | 1.38 | $1.7 \times 10^{-3}$ | 12.5 |
| 114 | Volume Graft Release Layer | $1.30 \times 10^{-3}$ | 1.77 | 1.38 | $5.3 \times 10^{-4}$ | 5 |
| 108 | Resistor | $3.06 \times 10^{-3}$ | 2.64 | 0.70 | $1.7 \times 10^{-3}$ | 153 |
| 109 | Volume Graft Insulating Layer | $1.30 \times 10^{-3}$ | 1.77 | 1.38 | $5.3 \times 10^{-4}$ | 5 |
| 102 | Stainless Steel | 0.15 | 7.92 | 0.46 | $4.1 \times 10^{-2}$ | 127 |

It is to be understood that while the figures and the foregoing description illustrate the present invention, they are exemplary only. Others who are skilled in the applicable arts will recognize numerous modifications and adaptations of the illustrated embodiment that will remain within the principles of the present invention. Therefore, the present invention is to be limited only by the appended claims.

What is claimed is:

1. A fuser roller comprised of:

a metallic cylindrical core having an axis;

an insulating layer of volume graft over said metallic core;

a resistive heating layer over said insulating layer; and electrical connections to said resistive layer such that an electrical current passing between said electrical connections flows through said resistive heating layer in a direction that is substantially parallel to the axis of said metallic core.

2. A fuser roller according to claim 1, further including a release layer over said resistive heating layer.

3. A fuser roller according to claim 2, wherein said release layer is comprised of volume graft.

4. A fuser roller according to claim 1, wherein said metallic core is comprised of a steel.

5. A fuser roller according to claim 1, wherein said resistive heating layer is a thick film coating.

6. A fuser roller according to claim 1, wherein said electrical connections include a conductive axle upon which said metallic core rotates.

7. A fuser assembly comprised of:

a fuser roller having a metallic core with an axis, a volume graft insulating layer over said metallic core, a resistive heating layer over said insulating layer; and electrical connections to said resistive heating layer such that an electrical current passing between said electrical connections flows through said resistive heating layer in a direction that is substantially parallel to the axis of said metallic core;

a backup roller adjacent said fuser roller so as to form a fusing nip; and an electrical power source for applying electrical current to said electrical connections so as to heat said fusing nip.

8. A fuser assembly according to claim 7, wherein said resistive heating layer is a thick film coating.

9. A fuser assembly according to claim 7, wherein said electrical connections include a conductive axle upon which said metallic core rotates.

10. A fuser assembly according to claim 7, further including a release layer over said resistive heating layer.

11. A fuser roller according to claim 10, wherein said release layer is comprised of volume graft.

12. A fuser assembly according to claim 10, further including a release agent management system for depositing a release agent on said release layer.

13. A printing machine, comprising:

a photoreceptor having a photoconductive surface;

a charging station for charging said photoconductive surface to a predetermined potential;

an exposure station for exposing said photoconductive surface to produce an electrostatic latent images on said photoconductive surface;

a developing station for depositing developing material on said electrostatic latent image so as to produce a toner image on said photoconductive surface;

a transfer station for transferring said toner image on said photoconductive surface to a substrate; and a fusing station for fusing said transferred toner image to said substrate, said fusing station including:

a fuser roller having a metallic core with an axis, an insulating layer comprised of volume graft over said metallic core, a resistive heating layer over said insulating layer; and electrical connections to said resistive heating layer such that an electrical current passing between said electrical connections flows through said resistive heating layer in a direction that is substantially parallel to the axis of said metallic core;

a backup roller adjacent said fuser roller so as to form a fusing nip; and an electrical power source for applying electrical current to said electrical connections so as to heat said fusing nip.

14. A fuser assembly according to claim 13, wherein said metallic core is comprised of a steel.

15. A fuser assembly according to claim 13, wherein said resistive heating layer is a thick film coating.

16. A fuser assembly according to claim 13, wherein said electrical connections include a conductive axle upon which said metallic core rotates.

17. A fuser assembly according to claim 13, further including a release layer over said resistive heating layer.

18. A fuser roller according to claim 17, wherein said release layer is comprised of volume graft.

19. A fuser assembly according to claim 17, further including a release agent management system for depositing a release agent on said release layer.

20. A fuser assembly according to claim 13, wherein said backup roller is comprised of a metal core surrounded by a heat-insulating layer.

* * * * *